US011499217B2

(12) United States Patent
Sombra et al.

(10) Patent No.: US 11,499,217 B2
(45) Date of Patent: Nov. 15, 2022

(54) PROCESS FOR PREPARATION AND USE OF INORGANIC MARKERS FOR SECURITY IDENTIFICATION/MARKING ON EXPLOSIVES, FUSES AND AMMUNITION AFTER DETONATION AND ON FIREARMS AND METAL PROJECTILES, PRODUCTS OBTAINED AND PROCESS OF INSERTING MARKERS ON EXPLOSIVES, FUSES AND AMMUNITION AND ON FIREARMS AND METAL PROJECTILES

(71) Applicant: META—SOLUÇÕES EM SEGURANÇA LTDA., Morungaba (BR)

(72) Inventors: Antonio Sergio Bezerra Sombra, Fortaleza (BR); Sheila Nogueira Rebouças, São Paulo (BR)

(73) Assignee: META—SOLUÇÕES EM SEGURANÇA LTDA., Morungaba (BR)

( * ) Notice: Subject to any disclaimer, the term of this patent is extended or adjusted under 35 U.S.C. 154(b) by 171 days.

(21) Appl. No.: 17/265,688

(22) PCT Filed: Aug. 3, 2018

(86) PCT No.: PCT/BR2018/050274
§ 371 (c)(1),
(2) Date: Feb. 3, 2021

(87) PCT Pub. No.: WO2020/024024
PCT Pub. Date: Feb. 6, 2020

(65) Prior Publication Data

US 2021/0340660 A1 Nov. 4, 2021

(51) Int. Cl.

| | |
|---|---|
| ***F42B 33/00*** | (2006.01) |
| ***C23C 8/66*** | (2006.01) |
| ***C23C 8/80*** | (2006.01) |
| *F42B 3/28* | (2006.01) |
| *F42B 5/02* | (2006.01) |
| *F42B 12/40* | (2006.01) |

(52) U.S. Cl.
CPC ..... *C23C 8/66* (2013.01); *C23C 8/80* (2013.01); *F42B 33/00* (2013.01); *F42B 3/28* (2013.01); *F42B 5/02* (2013.01); *F42B 12/40* (2013.01)

(58) Field of Classification Search
CPC ..... C23C 8/66; C23C 8/80; F42B 33/00
See application file for complete search history.

(56) References Cited

U.S. PATENT DOCUMENTS 9,500,457 B1 11/2016 Horch et al.

FOREIGN PATENT DOCUMENTS

WO 2010105326 A1 9/2010

OTHER PUBLICATIONS

Office Action (with English Translation) dated Oct. 26, 2021 and Response (with English Translation) filed on Dec. 23, 2021, in connection with corresponding Brazilian Application No. BR112021001378-4; 36 pages.
Hearns et al., "Preparation of a Ytterbium-tagged Gunshot Residue Standard for Quality Control in the Forensic Analysis of GSR"; Journal of forensic sciences; 2015; vol. 60, No. 3, pp. 737-742.
Notice of Allowance dated Feb. 1, 2022, in connection with corresponding Brazilian Application No. BR112021001378-4 (6 pp., including machine-generated English translation).

*Primary Examiner* — Jessee R Roe
(74) *Attorney, Agent, or Firm* — Maier & Maier, PLLC

(57) ABSTRACT

Development of different inorganic materials, having the capacity to generate visible colors when excited in the infrared region, which can be used to determine the origin of explosives, fuses and ammunition, even after detonation, and in weapons and metal projectiles, thus serving as a safety marking tool thereof. The following were developed: $LaNbO_4$ (called Mark1), $BiVO_4$, $Sr_3V_2O_8$ and $YNbO_4$ (called Mark2), doped with different rare earth ions (erbium, ytterbium, holmium and thulium). The markers were physically inserted inside the explosives and in the gunpowder and by carburizing and forging in steel or metal alloy, with which the weapon or metal projectile is manufactured. The parameter used to demonstrate the presence of the markers in the products, after detonation or scraping of the weapon, was the verification of the color identity of the marker fluorescence, before and after, via laser in the infrared region.

10 Claims, 17 Drawing Sheets
(10 of 17 Drawing Sheet(s) Filed in Color)

2A

2B

2C

PROCESS FOR PREPARATION AND USE OF INORGANIC MARKERS FOR SECURITY IDENTIFICATION/MARKING ON EXPLOSIVES, FUSES AND AMMUNITION AFTER DETONATION AND ON FIREARMS AND METAL PROJECTILES, PRODUCTS OBTAINED AND PROCESS OF INSERTING MARKERS ON EXPLOSIVES, FUSES AND AMMUNITION AND ON FIREARMS AND METAL PROJECTILES

FIELD

The present application for patent of invention refers to an unprecedented process of preparing inorganic markers that are fluorescent under the action of infrared light, for identification and marking, by means of specific insertion process, on explosives, fuses, ammunition after detonation, as well identifying and marking the steel and metal alloys of the firearms and metal projectiles.

The invention claimed will be used in the safety sector.

BACKGROUND

Explosives, fuses, ammunition, firearms and projectiles are normally controlled by batch marking. This type of control and even the products marked individually, which are rare, present a major problem, which is the destruction of said marking when the explosion occurs, when the projectile ignites or equivalent act. On the weapons, the markings are superficial and can normally be scraped off in order to conceal the serial number.

Nowadays, the markings are made by using unidimensional and/or bidimensional codes, on the primary and second packaging, which are obviously destroyed in the act of explosion, or else they are discarded upon unwrapping the product.

Batch controlling generates identical units, as the marking, as a rule, relates to what was produced on one day, which makes it impossible to distinguish the individual elements of that production. This type of control, by batches, generates a serious problem. Because the markings are removed when using the products cited, either by scraping, discarding, destruction of the label or any direct markings on the units of the products, it is not possible to state who the manufacturer was, nor the path that this product traveled to get to the point where it was used. This fact dissociates the act from any possibility of tracking, and makes it impossible to investigate the agents who were responsible for the use of a particular product, in some cases, illegally and often with significant social impact.

Changes in the surveillance system unequivocally seek the identification of the controlled product, even after the explosion or use. There are numerous illegal practices, which use anonymity and lack of traceability to act in ATM robberies, quarry robberies and haulers of products controlled by the Army. Terrorism, too, uses the lack of identification after the explosion to assume any act, even if it has no connection with the criminal organization that effectively committed the deed, improperly capitalizing the act for itself and consequently attracting more supporters.

In general, inorganic materials have applications in the most diverse areas, such as, for example, solid fuel cells, multilayer capacitors, photocatalysts, lasers, temperature sensors, imaging examinations, among other applications.

The large number of application possibilities of inorganic materials is justified by the fact that they have great variation in their properties, and in many cases it is still possible to change their chemical structure, to confer a new property (JUNLI, H.; et al. Promissing red phosphors LaNbO4: Eu3+, Bi3+ for LED solid-state lighting application. Journal of Rare Earths, v.28, p.356, 2010; LEE, H. W.; et al. Low-temperature sintering of temperature-stable LaNbO4 microwave dielectric ceramics. Materials Research Bulletin, v.45, p.21-24, 2010; MAGRASO, A.; HAUGSRUD, R.).

In the field of advanced inorganic materials there are several families, one of the most studied being the one that presents the Formula $ABO_4$, with fergusonite type structure. The materials of this family tend to undergo change to the scheelite phase when subjected to temperature. In general, these changes end up resulting in a variation of the composition of sites A and B. $LaNbO_4$, $YNbO_4$ and $BiVO_4$ materials fall within the description of the $ABO_4$ family.

Another group of inorganic materials studied in literature is the family of orthovanadates, whose chemical structure can be represented by the chemical formula $AB_3O_8$. These materials have a palmierite type structure, and many of these materials have terrous-alkaline metals in their constitution. The material $Sr_3V_2O_8$ falls under the description of an orthovanadate.

In short, the market practices the following ways of marking controlled products, relating to this patent application.

In the case of explosives and ammunition, the unidimensional and/or bidimensional markings are superficial and on the packaging.

In turn, weapons have a serial number marked superficially on the metal surface, a marking easily removed by scraping.

The current state of the art anticipates some patent documents that address ammunition marking, such as WO 2015/040236 entitled "Method and device for marking ammunition for identification or tracking" and WO 2015/040237 entitled "Method and device for marking ammunition or tracking".

In the above documents, the markings are mechanical, obtained by pressing the metal, leaving marks on the ammunition capsules. The above methods compete with the numerical marking made by mechanical means or laser, directly on the metal for including the serial number on the weapons. They are invasive and flawed methods, as they are subject to processes of scraping on the surface, since they are perceived by the naked eye. In addition, the marks made on the metal surface can compromise the quality of the projectile by changing its ballistic dynamics.

At the internet address http://www.lasape.iq.ufrj.br/markersquimicos.html, luminol type markers are used. They have been known in literature for a long time, yet they are excited by ultraviolet light.

In general, some materials have already been tested to monitor residues from firearm shots such as $ZnAl_2O_4$ and Ln(DPA)-(HDPA) (I. T. Weber et al. 'Use of luminescent gunshot residues markers in forensic context', Forensic Science International 244 (2014) 276-284), and Ln(DPA)-(HDPA)] and (I. T. Weber et al. 'High Photoluminescent Metal Organic Frameworks as Optical Markers for the Identification of Gunshot Residues, dx.doi.org/10.1021/ac200680a|Anal. Chem. 2011, 83, 4720-4723). In these studies markers are examined under the action of ultraviolet light and electron microscopy.

SUMMARY

It is an objective of the present invention to propose a marking process using inorganic markers for identification and safety marking on explosives, fuses, ammunition, firearms and metal projectiles, making it possible to track products controlled by the military authorities and other possibly hazardous products, even after their effective use (explosion) and/or up until the end of their useful life. This because it binds the manufacturer to the traceability process, a necessary link in a chain of information for any investigation.

It is an objective of the present invention to propose a marking process using inorganic markers for identification and safety marking on explosives, fuses, ammunition, firearms and metal projectiles, that will bring competitive advantages to the production chains of these products, due to their better logistical and safety control.

It is an objective of the present invention to propose a marking process using inorganic markers for identification and safety marking on explosives, fuses, ammunition, firearms and metal projectiles, capable of protecting the legally-constituted industry from fraud, robbery and deviation, as well as enabling an entire distribution chain, up to end use, the guarantee of origin of the products.

It is an objective of the present invention to propose a marking process using inorganic markers for identification and safety marking on explosives, fuses, ammunition, firearms and metal projectiles, which will improve quality guarantee mechanisms, among users and consumers through forensic analysis. This will generate new capacities of prevention and combat against unlawful deviation in handling these products.

It is an objective of the present invention to propose a non-invasive process using inorganic markers for identification and safety marking on explosives, fuses, ammunition, firearms and metal projectiles.

It is an objective of the present invention to propose a marking process using inorganic markers for identification and safety marking on explosives, fuses, ammunition, firearms and metal projectiles, which does not bear visible marks.

It is an objective of the present invention to propose a marking process using inorganic markers for identification and safety marking on explosives, fuses, ammunition, firearms and metal projectiles, wherein the marking can only be identified by expert examination, applying a laser for identifying and reading.

It is an objective of the present invention to propose a marking process using inorganic markers for identification and safety marking on explosives, fuses, ammunition, firearms and metal projectiles, whose inorganic marker withstands high temperatures and does not interfere in the composition of the ammunition and the metal.

It is an objective of the present invention to propose a marking process using inorganic markers for identification and safety marking on explosives, fuses, ammunition, firearms and metal projectiles, which does not alter any structural characteristic of the ammunition or the firearm.

It is an objective of the present invention to propose a marking process using inorganic markers for identification and safety marking on explosives, fuses, ammunition, firearms and metal projectiles, which does not bear visible marks, that is, it is not visible to the public at large.

It is an objective of the present invention to propose a marking process using inorganic markers for identification and safety marking on explosives, fuses, ammunition, firearms and metal projectiles, wherein the inorganic marker is inserted into the mass of the product (explosive or ammunition) and remains with the DNA of the manufacturer even after the explosion and throughout the useful life of the product.

It is an objective of the present invention to propose a marking process using inorganic markers for identification and safety marking on explosives, fuses, ammunition, firearms and metal projectiles, wherein the inorganic marker is inserted into the metal structure of the weapon and scattered such that it is invisible and impossible to remove. Therefore, the product remains with the DNA of the manufacturer even after the attempt at scraping and during the useful life of the weapon.

MARKERS FOR SECURITY IDENTIFICATION/MARKING ON EXPLOSIVES, FUSES AND AMMUNITION AFTER DETONATION AND ON FIREARMS AND METAL PROJECTILES, PRODUCTS OBTAINED AND PROCESS OF INSERTING MARKERS ON EXPLOSIVES, FUSES AND AMMUNITION AND ON FIREARMS AND METAL PROJECTILES—refers to a process of preparing a group of materials, based on different inorganic matrices doped with rare earth ions, which demonstrate different colors in the visible region when excited with laser in the infrared region. The markers can be used to indicate the origin of explosives, fuses and ammunition and thus serve as safety marking, indicating the origin of these hazardous products even after detonation. The same markers can be used to mark steel and its alloys with application in firearms and metal projectiles.

The same inorganic marker is inserted in different ways into the explosive, the ammunition and the steel of the weapon or cartridge, in the latter (steel of the weapon or cartridge) it may be by carburizing or forging.

Basically, for testing with explosives, the marker was inserted into the emulsion (mass of 110 g), cartridged, dynamite banana or the like. In the ammunition, the inorganic marker was mechanically mixed with a gunpowder and this was detonated inside polyethylene and metal casing. It was also introduced in gunpowder used in ammunition for use in caliber 38 revolvers and in caliber 380 pistols.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The figures set out below are for improved explanation of the patent application in an illustrative, non-limitative manner.

DETAILED DESCRIPTION OF THE EMBODIMENTS

The PROCESS FOR PREPARATION AND USE OF INORGANIC MARKERS FOR SECURITY IDENTIFICATION/MARKING ON EXPLOSIVES, FUSES AND AMMUNITION AFTER DETONATION AND ON FIREARMS AND METAL PROJECTILES, PRODUCTS OBTAINED AND PROCESS OF INSERTING MARKERS ON EXPLOSIVES, FUSES AND AMMUNITION AND ON FIREARMS AND METAL PROJECTILES, consists of the development of different inorganic materials, with the ability to generate visible colors when excited in the infrared region, which can be used to determine the origin of explosives, fuses and ammunition, even after detonation, as well as in weapons and metal projectiles, thus serving as a safety marking tool thereof. $LaNbO_4$ (called Mark1), $BiVO_4$, $Sr_3V_2O_8$ and $YNbO_4$ (called Mark2), doped with different rare earth ions (erbium, ytterbium, holmium and thulium) were developed. The markers were physically inserted within the explosives and in the gunpowder and by carburizing and forging in steel or metal alloy, with which the metallic gun or projectile is manufactured. The parameter used to demonstrate the presence of markers in the products, after detonation or scraping of the weapon, was the verification of the color identity of the marker fluorescence, before and after, via laser in the infrared region.

More particularly, the invention consists of the development and preparation of inorganic materials used as markers. The materials were prepared using the solid-state reaction method, wherein the inorganic oxides were mixed according to the desired stoichiometric proportions. The oxides were packed in polyacetal reactors containing 0.1 mm diameter zirconia spheres and then the grinding process using a Pulverisette® planetary mill 5 at a speed of 360 rpm for 4 hours was carried out. The reaction to the formation of markers is as follows:

$$0.89La_2O_3+Nb_2O_5+0.01Er_2O_3+0.10Yb_2O_3 \rightarrow 2La_{0.89}Er_{0.01}Yb_{0.10}NbO_4$$

$$0.845Y_2O_3+Nb_2O_5+0.005Tm_2O_3+0.15Yb_2O_3 \rightarrow 2Y_{0.845}Tm_{0.005}Yb_{0.15}NbO_4$$

$$0.89Bi_2O_3+V_2O_5+0.01Ho_2O_3+0.10Yb_2O_3 \rightarrow 2Bi_{0.89}Ho_{0.01}Yb_{0.10}VO_4$$

$$2.88SrCO_3+V_2O_5+0.03Ho_2O_3+0.09Yb_2O_3 \rightarrow Sr_{2.88}Ho_{0.03}Yb_{0.09}V_2O_8+2.88CO_2$$

The materials obtained were then taken to Jung resistive furnaces® so that they could be calcined and thus the desired markers were obtained. The Mark1 marker was calcined at the temperature of 1100° C. for 4 hours, while the other markers were obtained at the same time and temperature.

Figure 1:
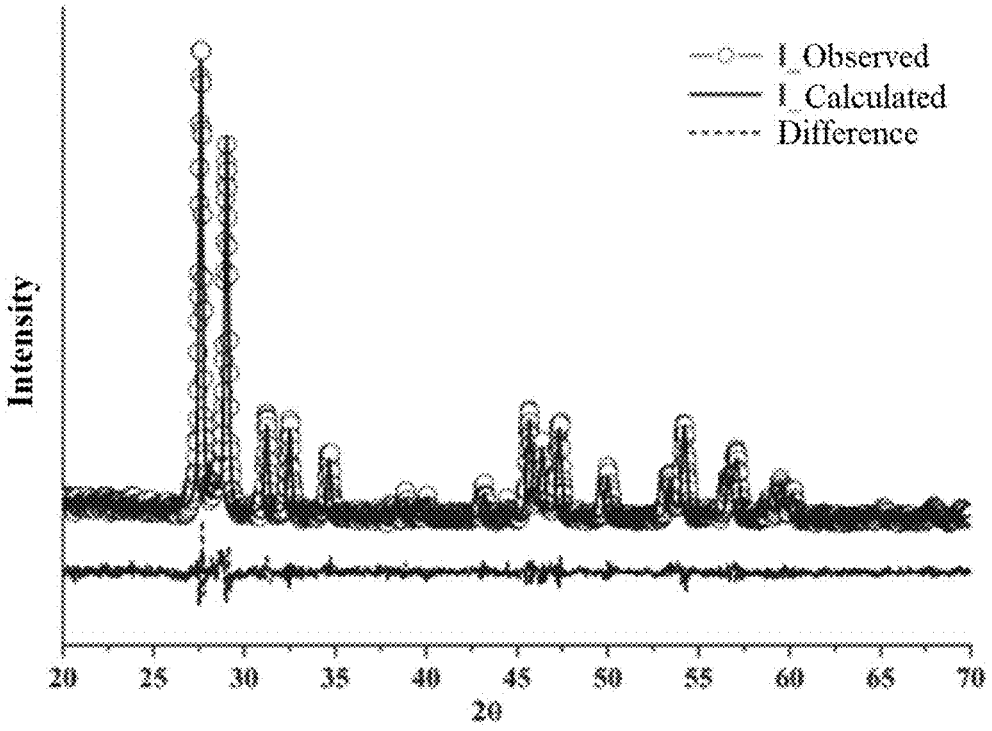
FIG. 1: X-ray diffraction result. Diffraction peaks characteristic of one of the inorganic matrices used as marker. No additional diffraction peaks were identified, which demonstrates that there is no presence of any reagent or spurious phase. The crystallographic pattern used to identify the phase in Rietveld refinement was ICSD 81616. The small residual difference between the theoretical (calculated) and the experimental (observed) results can be perceived in detail, that is, it is shown that the material formed is actually $LaNbO_4$ doped with erbium and ytterbium (Mark1). The X axis is the diffraction angle and the Y-axis is the diffracted intensity.

The synthesis of the marker was monitored by the x-ray diffraction technique and the presence of latter was confirmed by the refinement of the experimental diphratogram by the Rietveld method. The parameters obtained for Rietveld refinement, for the synthesis of the $LaNbO_4$ (Mark1) doped material are given as examples, and the values in this case were $R_{wp}$=18.30%, S=1.12% and $R_{Bragg}$=4.22%, where only a crystalline phase was used and the values obtained are within the limits considered adequate for a good refinement procedure. FIG. 1 presents the result of Rietveld's refinement to the synthesized material $LaNbO_4$ (Mark1), where it is possible to note a very small difference between the experimental diffraction profiles and that calculated from Rietveld refinement, which confirms the argument that the refinement carried out is reliable. The same procedure was carried out for the other phases with results that also confirmed their achievement.

Figure 2:
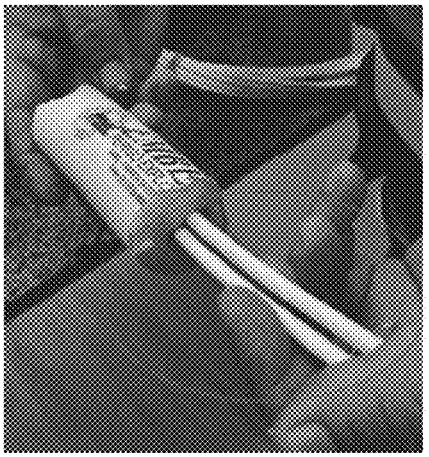
FIG. 2: Photographs of the technical details of the explosives used in the tests, with the emulsion (dynamite), showing the emulsion fuse system (2A)—fuse+circulated fuse—, fuse and emulsion with different markers (2B) and final system inside the enclosure (2C).
Figure 2:
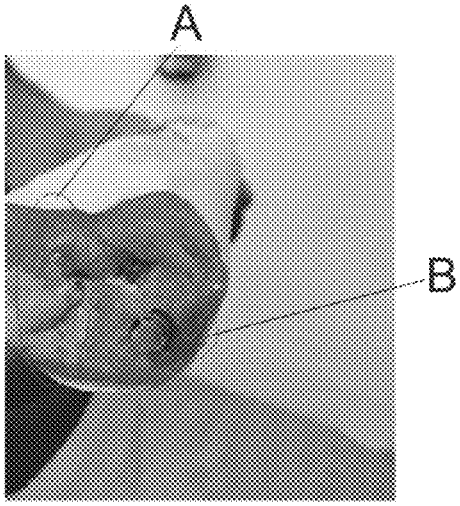
Figure 2:
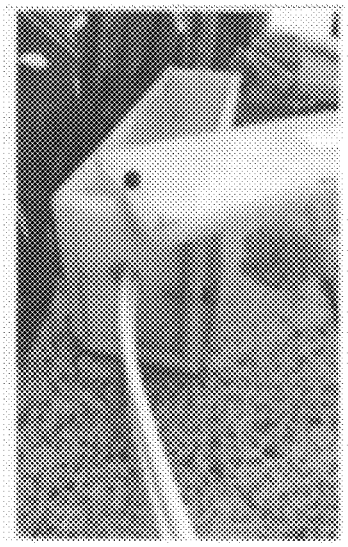
Figure 3:
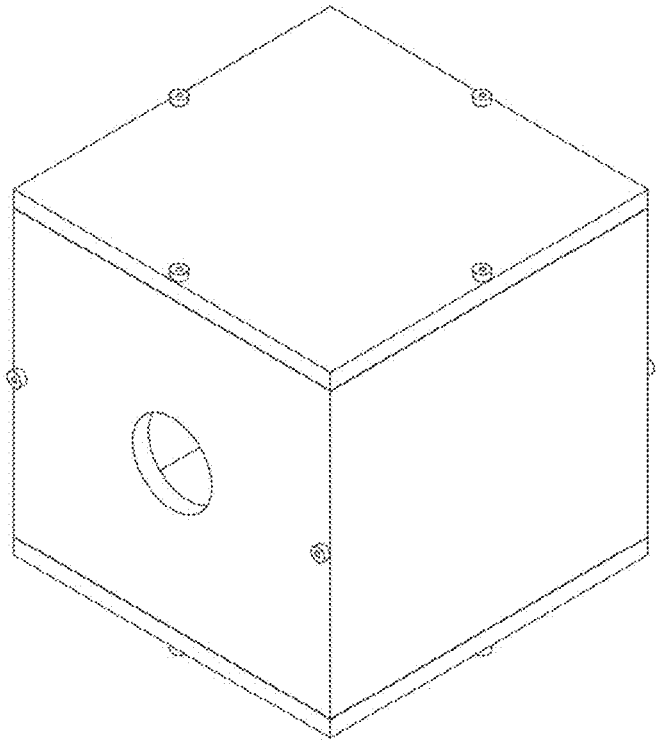
FIG. 3: Perspective view of the polyacetal/metal casing used in explosives tests.

In order to verify the marking capability of the inorganic materials, more specifically Mark1 and another marker, Mark2, they were inserted directly into two different regions of the tested explosives. FIG. 2 displays photos with test details. The tested marker was inserted in emulsion (A), mass of 110 g, cartridged/dynamite banana, now in fuse (B), mass of 0.8 g, of explosives used in the test, both with different markers. The purpose of placing the marker in these two regions was to verify the possibility of detecting its presence, regardless of the mass of the marker used, since the concentration of the marker was directly related to the mass of the fuse or emulsion. A total of 1.1 g of marker was inserted into the emulsion (dynamite banana), and this presented mass of 110 g. In the other test, 0.008 g, or 8 mg, of marker only in the fuse, which had mass of 0.8 g was added. In both tests, the marker was detected after detonation in the residues of the explosion. Therefore, for the second test, with the marker inserted in the fuse and detonation was performed in the fuse+emulsion set, it was observed that the marker was diluted 13850 times, approximately, in relation to the explosive material, that is, 1 part of marker for 13750. It was also effectively possible to note the detection of the marker for detonations with dopings in the scale of 1 (one) part of marker to 15000 parts per mass of emulsion. After the insertion of the marker in the explosives, these were placed in polyacetal and metal casings and thereafter were detonated following the safety standards of the Brazilian Army. FIG. 3 shows the constructive detail of the casings used in the tests. The debris resulting from the explosions of the casings were collected and analyzed in order to detect the presence of the marker in the residues, which were embedded in the casings.

For the marker tests in the ammunition, two types of tests were performed. In the first, individual marker mixture was performed with gunpowder. In one of the tests, 0.01 g (10 mg) of each of the inorganic markers were mechanically mixed with 10 g of gunpowder. In the other test, 0.001 (1 mg) of markers were mixed with 10 g of gunpowder. This mixture was also detonated inside polyacetal and metal casings (structures equal to those used in the tests of dynamite detonation). After detonation, the debris from the casings was collected and taken for analysis in the laboratory. For both tests the markers were detected after the detonations in the residues of the casings (metal and plastic). For the second test, the marker was inserted into the gunpowder used in ammunition for revolvers and pistols to be described below.

Figure 4:
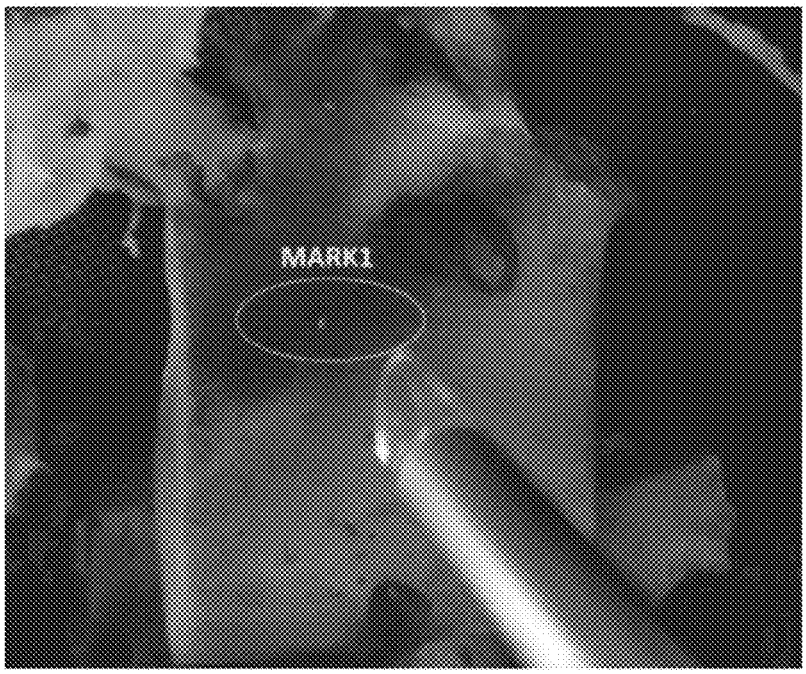
FIG. 4: Photograph of a polyacetal casing, after detonation, being excited by a commercial infrared emitting laser. The green color observed in the explosion residues refers to the presence of the inorganic marker Mark1 (4A) in one part and the inorganic marker Mark2 in the other part (4B).
Figure 4:
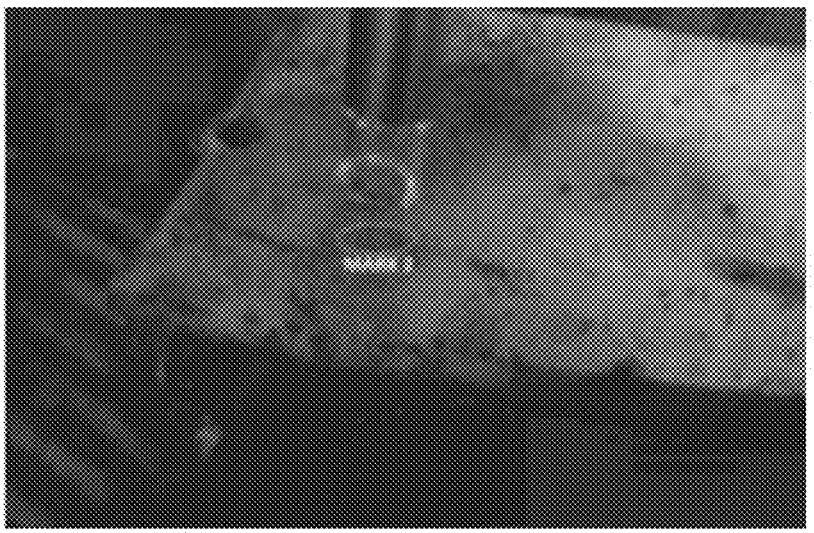

For the explosives tests, the residues of the explosions were initially tested with a commercial laser, which emits infrared radiation with a length of 980 nm. In FIG. 4, a photograph is presented wherein the residues from the detonation of explosives in the polyacetal casing, demonstrate the color green when they are excited by the laser. This color green is characteristic of the inorganic marker Mark1 (4A), which was inserted in explosive artifacts, and this result confirms that the marker used in the tests, even after the explosion, remains present and demonstrates active fluorescence. It also features the lilac color for the marker Mark2 (4B). It is worth mentioning, as already commented, that the marketer did not cause any kind of interference in the result of the detonation of explosives, that is, markers are inert materials in light of the components present in the explosives. The explosives maintained all their detonation power characteristics.

Figure 5:
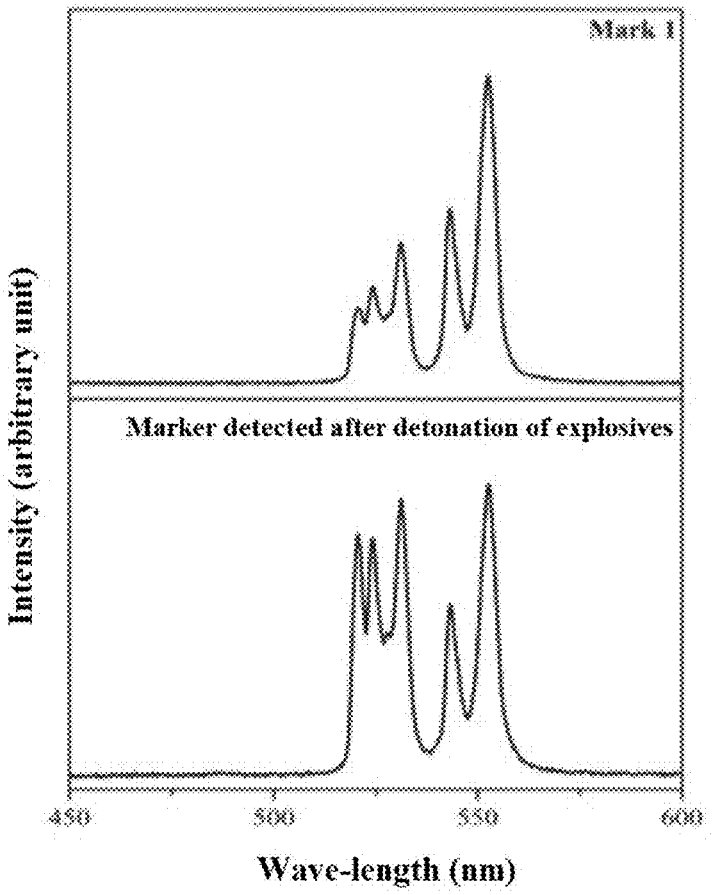
FIG. 5: Graph of the fluorescence spectrum upconversion in the range of 450 to 600 nm, which was obtained for one of the samples of polyethylene post-detonation in comparison with the pure Mark1 spectrum. These fluorescence measurements were taken using a bench top laser.

For a more detailed analysis of fluorescence obtained from the residues, a Diode-Pumped Solid State Laser (DPSSL) model LD-WL206 with excitation wavelength of 980 nm (infrared region) was used. All residues of the casings tested with the laser presented the color green perceivable to the naked eye, and for demonstration is presented in FIG. 5, a fluorescence spectrum obtained for the residues of a polyacetal casing in comparison with the spectrum of the pure marker. The spectra obtained revealed the presence of fluorescent bands in the range of 500 to 600 nm, and this region refers to the color green.

Figure 6:
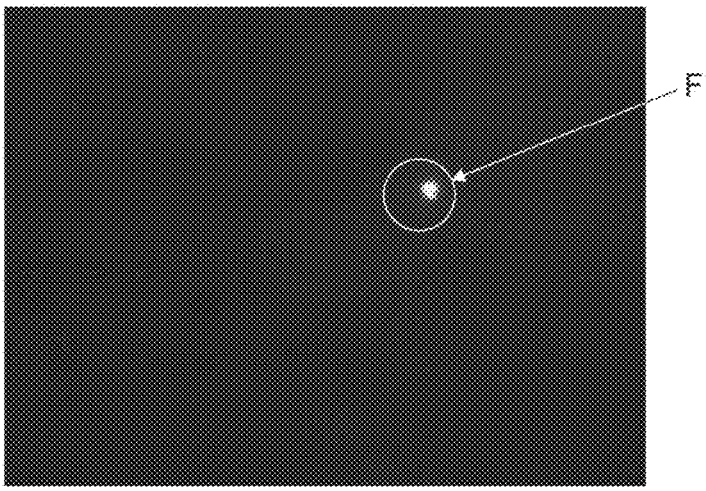
FIG. 6: Photograph of a metal casing, after detonation, used in gunpowder test (munition), being excited by a commercial infrared emitting laser. The circled one, in the green color observed in the explosion residues, refers to the presence of the inorganic marker Mark1.

For gunpowder tests, residues collected after detonation were also preliminary analyzed with commercial infrared radiation emitting laser. FIG. 6 shows a photograph, wherein the residues of the gunpowder explosion in the casing metal, demonstrate the color green when excitation occurs using the commercial laser. This color green is characteristic of the inorganic marker Mark1, which was placed in gunpowder and this result demonstrates that the markers used in the tests, even after the explosion, are still present and present active fluorescence (F). As in the tests of explosives, the markers used did not cause any kind of interference in the result of the explosion, that is, the inorganic materials used are inert in light of the chemical components present in the gunpowder.

Figure 7:
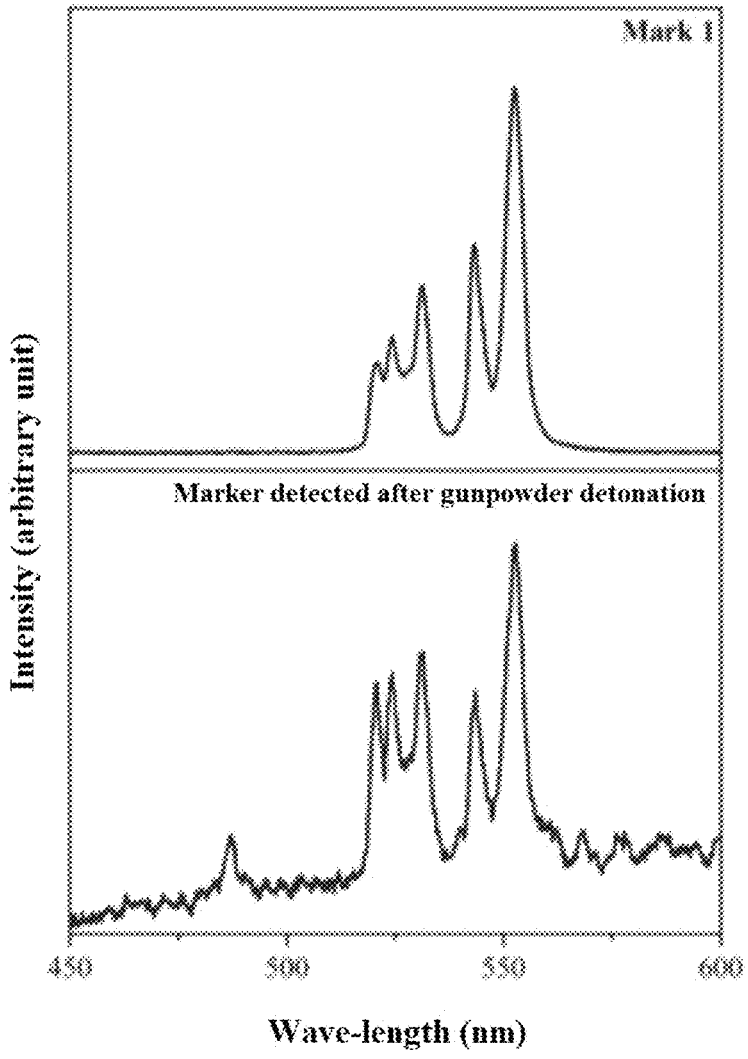
FIG. 7: Graph of the fluorescence spectrum upconversion in the range of 450 to 600 nm, which was obtained for one of the samples of the metal casing after detonation in comparison with the pure Mark1 spectrum. These fluorescence measurements were taken using a bench top laser.

A more detailed analysis of fluorescence obtained from the residues, was carried out by employing the same bench laser used to analyze the residues of explosives. Again it was noted that all casings tested with this laser, presented the color green perceivable by the naked eye. To demonstrate the results is shown in FIG. 7, a fluorescence spectrum obtained in the residues of a metal casing compared with the pure marker spectrum, wherein it is noted the presence of fluorescent bands in the range of 500 to 600 nm, which is the region referring to color green.

Figure 8:
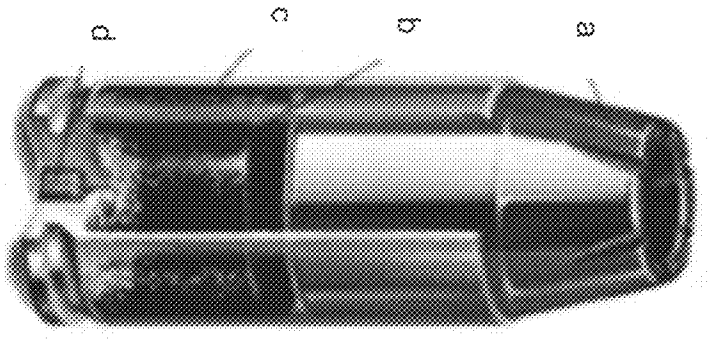
FIG. 8: Sectional photograph illustrating the structure of an ammunition, composed of projectile (a), case (b), gunpowder (c) and fuse (d).
Figure 9:
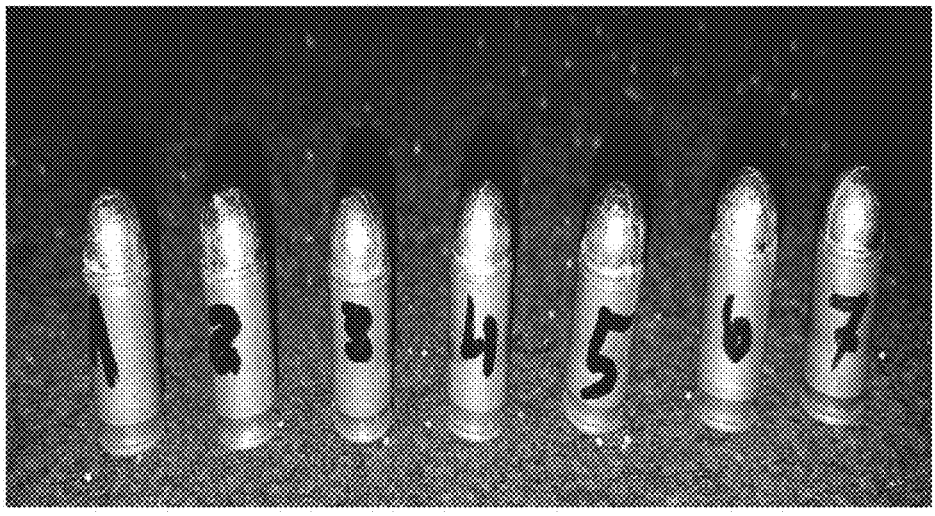
FIG. 9: Photograph of the ammunition of a caliber 380 pistol used in the tests.

The ammunition can be described as a combination between the projectile (bullet), the propellant (gunpowder) and the initiator (fuse) that are packaged in a capsule/case, forming a single unit, as presented in FIG. 8.

This marking was obtained through the mechanical mixture of the marker (Mark1) with the gunpowder and subsequent assembly of the bullet.

After firing the weapon gases and other residues jointly with the projectile are expelled. These residues are products of the burning of gunpowder, the initiator, cartridge metals and metal originating from the weapon. After the shooting, the metal case, the projectile and the glove used in the test by the shooter were examined. Using an infrared laser, it was possible to detect the presence of the marker Mark1 in all these objects as presented in FIGS. 11, 12, 13 and 14. To verify the marking capacity of the inorganic materials, tests were performed where the marker was introduced into the gunpowder used in the ammunition. Mark1 was mechanically mixed with the gunpowder and this was added in some revolver caliber 38 (RT 86) and pistol 380 (PT 58) projectiles. For the caliber 38, a common case of this caliber was used, and the amount of gunpowder that is used in a bullet of this caliber was weighed to calculate the amount of marker to be used in the tests. It was established that the mass of gunpowder used in a bullet of caliber 38 was 330 mg and from this value different masses of Mark1 were weighed, in order to obtain concentrations of 1%, 4%, 6%, 8%, 10%, 12% and 14% of this marker in relation to mass of gunpowder. The marker was added to the gunpowder so that the total mass of gunpowder+Mark1 was kept constant at 330 mg (original mass of a 38 projectile) and 290 mg for the pistol.

Once the marker was added, the ammunition was closed by inserting the projectile into the case by a cartridge refill press. The marking was done in duplicate, for each of the concentrations of markers, so two sets of similar bullets were prepared for revolver and pistol.

In this way, the ammunition used was 38 caliber for the revolver. Two shots were fired with each marker concentration using an RT86 TAURUS revolver totaling 14 shots and a pistol 380 (PT 58) with 14 shots in the same concentrations. For each shot, the shooter used a disposable glove for further detection analysis of the residues. In addition to the gloves, residues were also collected in the barrel and in the cylinder of the revolver and in the loader after the shots using a cotton swab.

Figure 10:
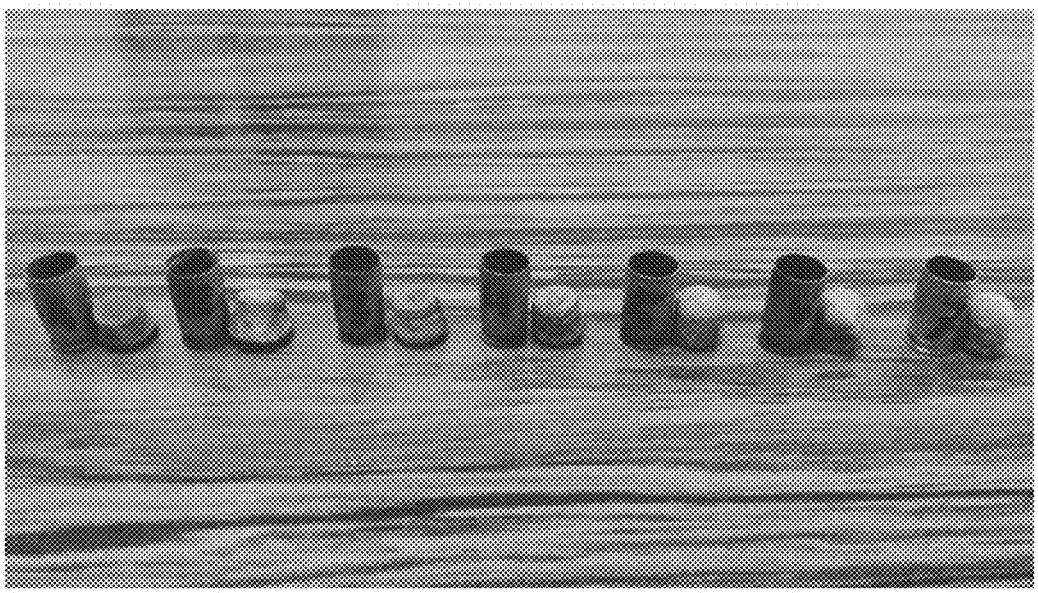
FIG. 10: Photograph of the cases and projectiles of the caliber 380 pistol ammunition used in the tests.
Figure 11:
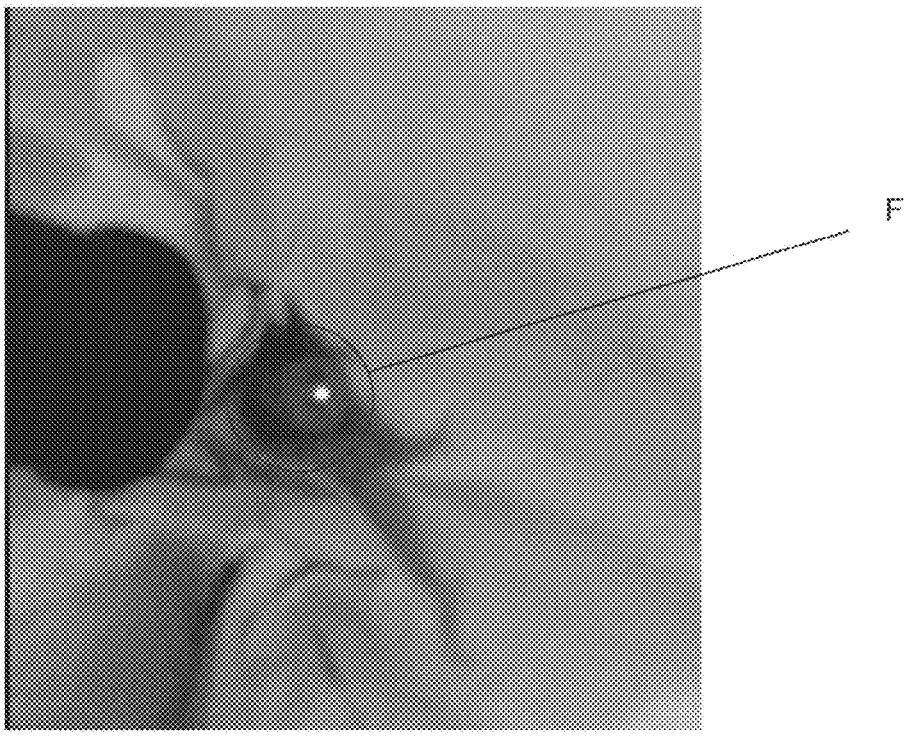
FIG. 11: Photograph illustrating the color green on the projectile, after firing the ammunition, the concentration of 1%, when excited with an infrared laser.
Figure 12:
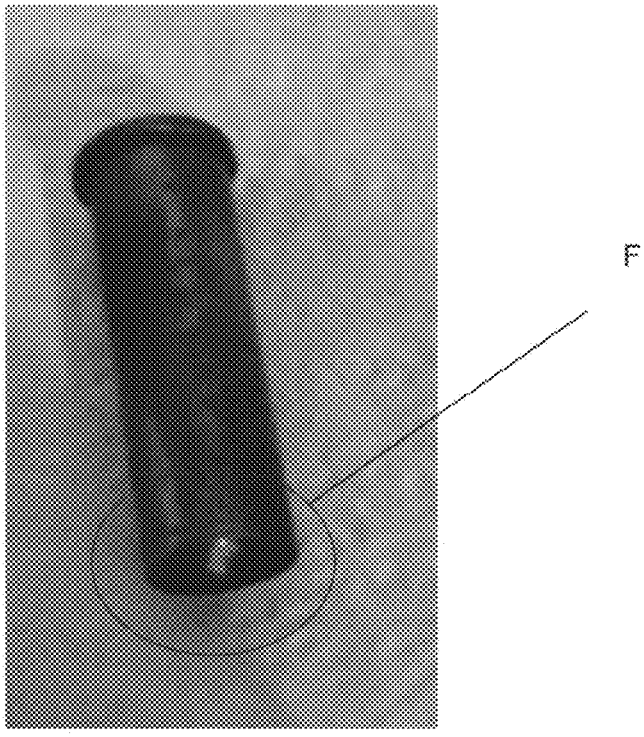
FIG. 12: Photograph illustrating the color green on the case, after firing the ammunition, the concentration of 1%, when excited with an infrared laser.
Figure 13:
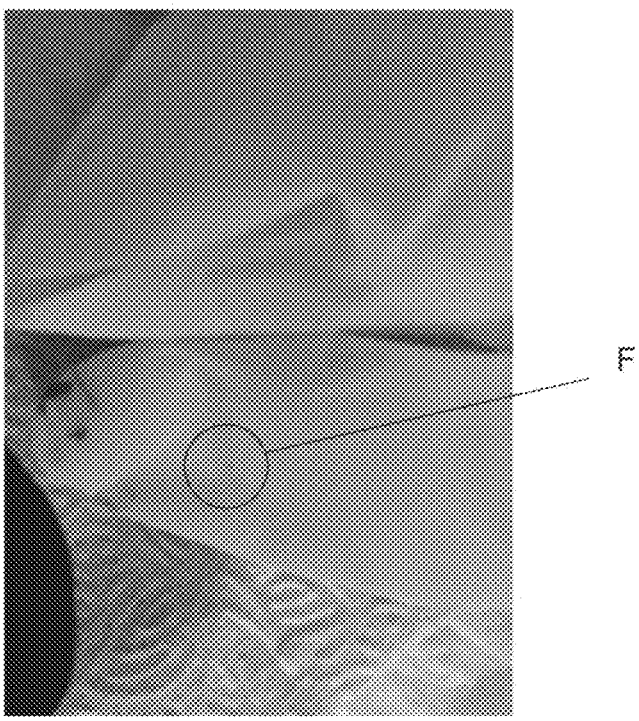
FIG. 13: Photograph illustrating the color green on the glove, after firing the ammunition, the concentration of 1%, when excited with an infrared laser.
Figure 14:
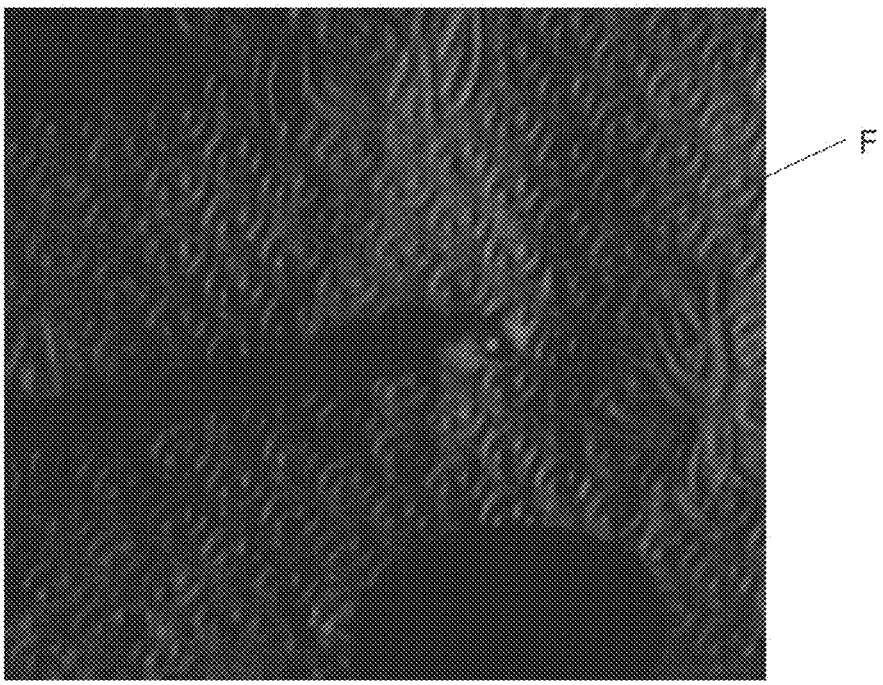
FIG. 14: Photograph illustrating the color green on the cotton swab, after firing the ammunition, the concentration of 1%, when excited with an infrared laser.

FIG. 8 illustrates the bullets used in the tests numbered 1,2,3,4,5,6 and 7 corresponding to the increase in the marker concentration of 1%, 4%, 6%, 8%, 10%, 12%, 14%, for use in the pistol and revolver. FIG. 10, illustrates the cases after the shots, jointly with the projectiles collected after the shots, for the pistol.

For the caliber 38, a common case of this caliber was used, and the amount of gunpowder that is used in a bullet of this caliber was weighed to calculate the amount of marker to be used in the tests. The mass of gunpowder used in a caliber 38 bullet is 330 mg and from this value different masses of Mark1 were weighed in order to obtain concentrations of 1%, 4%, 6%, 8%, 10%, 12%, 14% of this marker in relation to gunpowder. The marker was added to the gunpowder such that the total mass of gunpowder+marker=330 mg (original mass of a caliber 38 projectile). For the pistol 380, the procedure was the same, and the only change occurred in the mass of gunpowder used in the projectiles, which is 290 mg. After adding the marker, the ammunition was closed by inserting the projectile into the case by means of a cartridge refill press. The marking was done in duplicate, for each of the concentrations of markers. Thus, two sets of projectiles similar for revolver and pistol were prepared.

Thus, two shots were made with each concentration of marker Mark1, using an RT86 TAURUS revolver and a pistol 380 (PT 58) with 14 shots in the same concentrations. For each shot, the shooter used a disposable glove for further detection analysis of the residues. In addition to the gloves residues were also collected in the barrel and cylinder of the revolver and in the pistol loader, after the shots, using a cotton swab.

Figure 15:
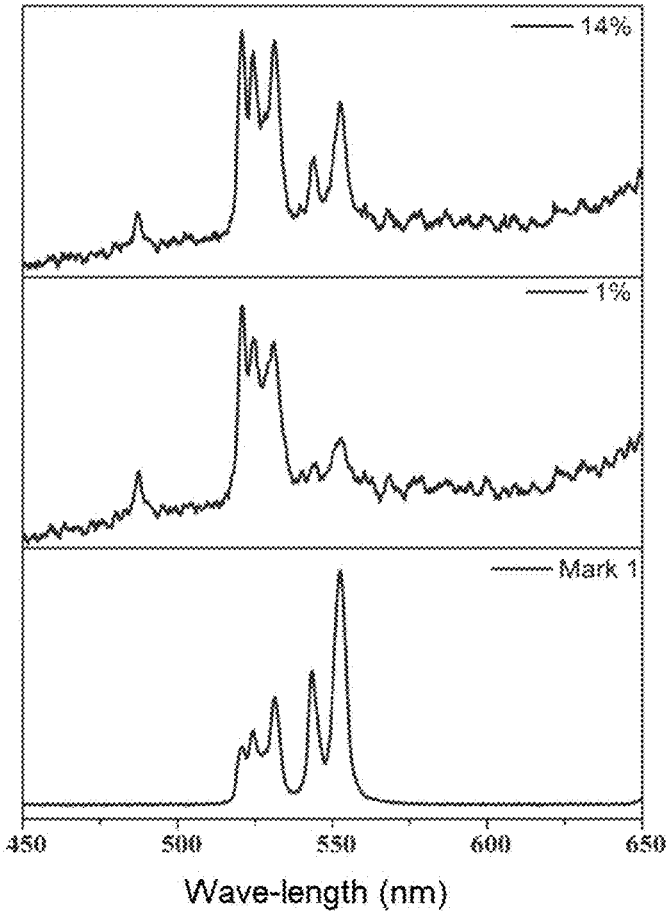
FIG. 15: Graph of the fluorescence spectra upconversion of 450 to 650 nm which was obtained from the projectiles with concentrations of 1% and 14% of the marker in the firing with the caliber 38 revolver, compared to the pure Mark1.

FIG. 15 shows the graph with the spectra fluorescence of the cases of the bullets with 1% and 14% of the tests with revolver 38 that were obtained after the shots in comparison with the Mark1. As can be observed, the fluorescence obtained is quite similar to that of the original marker, which confirms the presence of Mark1 in the projectiles even after the shots. In all other cases, with intermediate concentrations, the presence of Mark1 was noted after the shots both using the caliber 38 revolver and using the pistol 380, showing that the marker used is stable, is present after the firing of firearm and that the marking of the ammunition tested effectively occurred.

For the analysis of fluorescence emitted by the residues of ammunition marked with marker Mark1, a solid state diode bench laser (DPSSL)—model LD-WL206—with excitation wavelength at 980 nm was used. FIGS. 11 to 14 show a marking in the color green for the projectile and case of the shots from the caliber 38 revolver the concentration of 1% (lowest concentration of marker used in the tests), as well as residues on the glove and on the cotton swab, that is, residues were found, verified with active fluorescence (F), in all objects that came into contact with gunpowder after the shooting.

Figure 16:
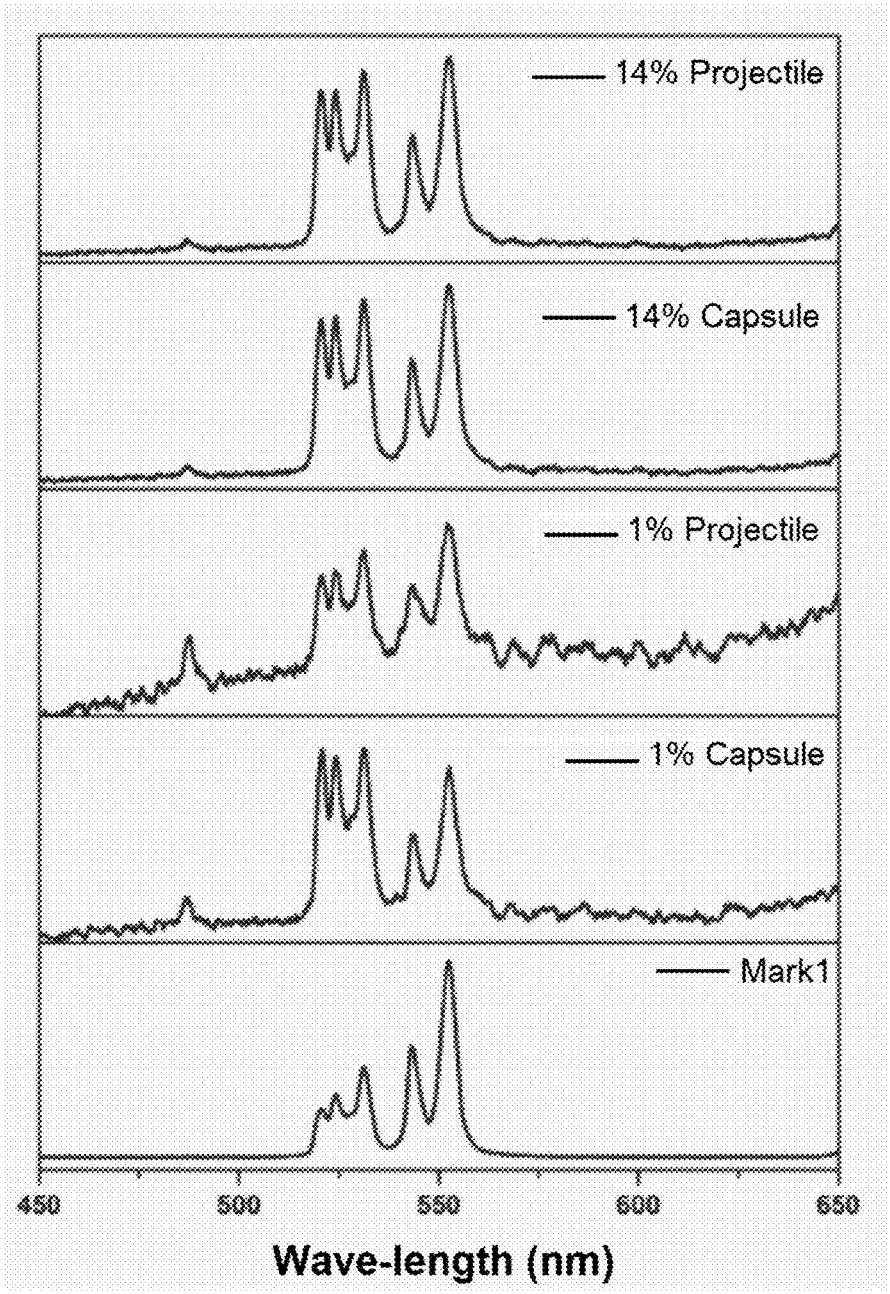
FIG. 16: Graph of the fluorescence spectra upconversion of 450 to 650 nm which was obtained cases and projectiles collected after the firing relating to the concentrations of 1 and 14% respectively, using the pistol 380 in comparison with the marker pure Mark1.

FIG. 16 shows the graph with spectra fluorescence of the cases of projectiles with 1% and 14% of the tests with pistol 380, which were obtained after shots in comparison with Mark1. It is observed that fluorescence is very similar to that of the original marker, which confirms the presence of the Mark1 in the projectiles even after the shots. In all other cases with intermediate concentrations, the presence of Mark1 was also noted after the shots, both in the caliber 38 revolver and in the pistol 380, which demonstrates that the Mark1 is stable, as it was found after the firing of the firearm and the marking of the ammunition tested effectively occurred.

Figure 17:
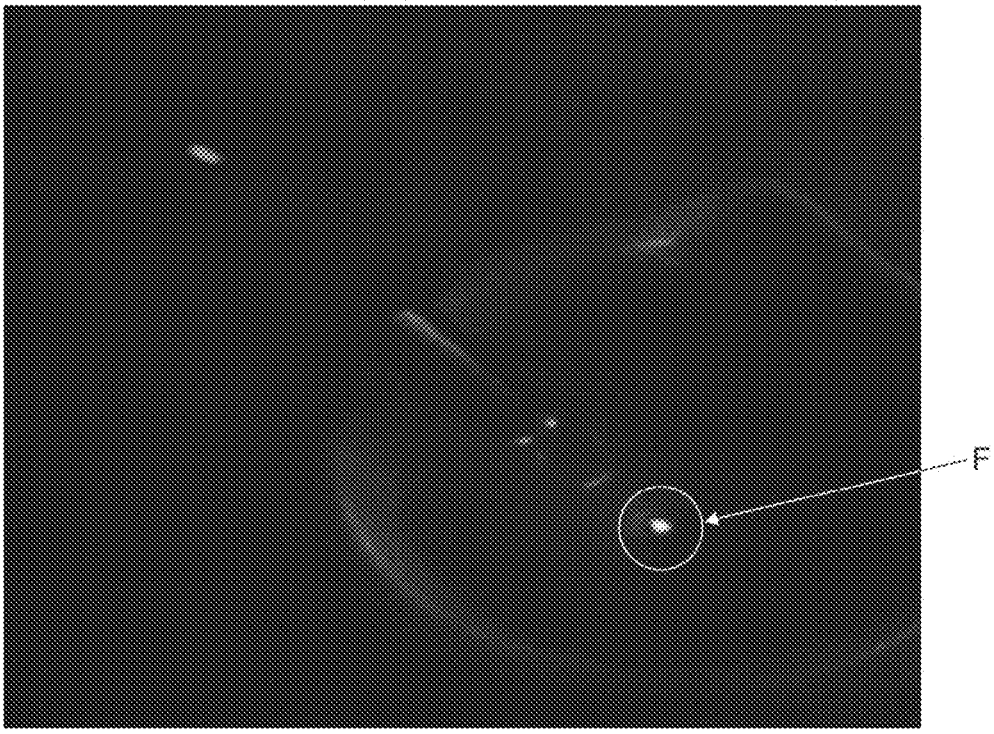
FIG. 17: Photograph illustrating the color blue observed for the material $YNbO_4$ doped with thulium and ytterbium, when latter is excited with an infrared laser.

The results presented for both explosives and gunpowder tests were with the use of the $LaNbO_4$ marker (Mark1), and all other markers also proved to be efficient as well as their marking capacity. Since these other markers present as differential, the fact of generating different colors to $LaNbO_4$ (Mark1). As an example, the marker $YNbO_4$ (Mark2) doped, shown in FIG. 17, which features the color blue.

In the case of the use of markers in steel or steel alloys of weapons and metal projectiles, to verify the marking capacity of inorganic materials two types of tests were performed for inclusion of markers in the parts: carburizing and forging.

Figure 18:
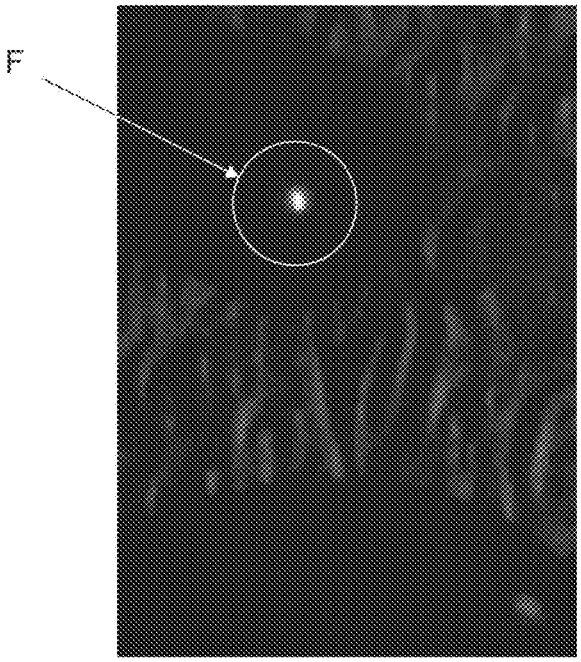
FIG. 18: Photograph of a metal part marked with marker Mark1 after the carburizing process at 900° C. and which underwent oil quenching.
Figure 19:
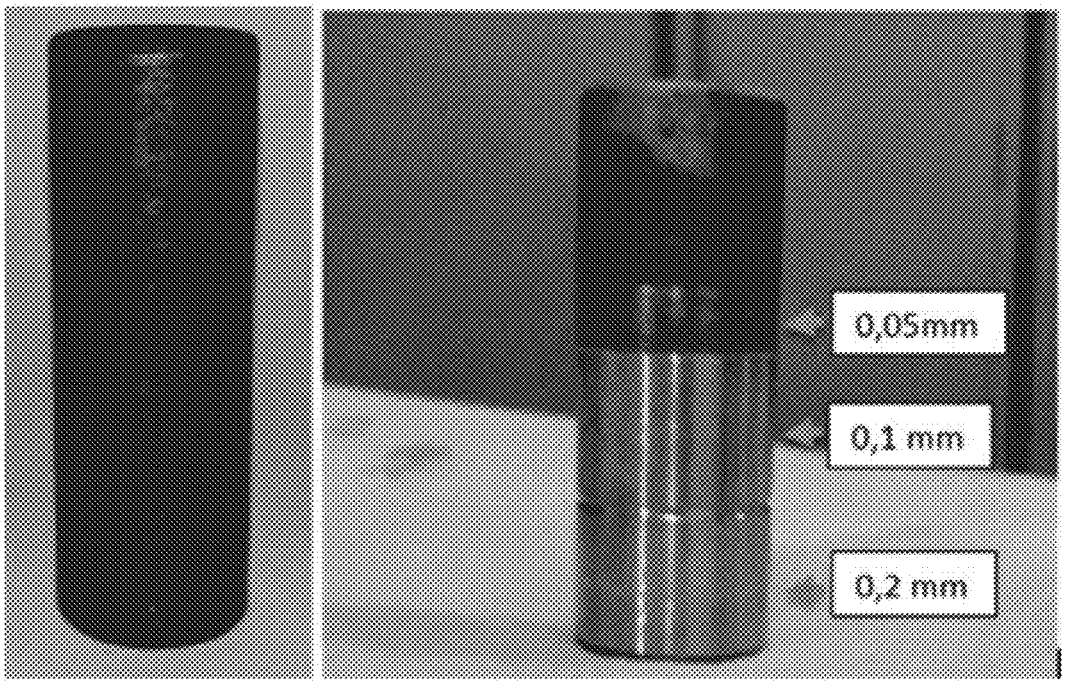
FIG. 19: Photograph of a metal part marked with marker Mark1 in the carburizing process and the metal part after thinning in different layers (0.05 mm//five hundredths of a millimeter, 0.1 mm//one tenth of a millimeter and 0.2 mm//two tenths of a millimeter).

In carburizing, a mixture of 10% to 20% in marker was used in a mixture specifically for carburizing, which consists of powder for carburizing. The mixtures of powders were carried out manually using a spatula. Therefore, a mixture mass of 5 g (1 g of the marker+4 g of the mixture for carburizing) was used. The container used to insert the metal parts and a mixture was an alumina crucible with a height of 55.0 mm and diameter of 45.0 mm. The metal parts were immersed throughout the carburizing mixture. The metal parts, in this feasibility form of the invention, steel 4140, with dimensions of 50.0 mm in height and 19.0 mm diameter were subjected to the temperature of 900° C., thereafter placed individually on the marking mixture for the period of one minute and subsequently subjected to oil quenching (FIG. 18). The test part was thinned with depths of 0.05 mm (50 μm); 0.1 mm (100 μm) and 0.2 mm (200 μm) to check how deep the fluorescent marker signal could be observed. FIG. 19 shows the test part after carburizing and the test part after thinning.

Figure 20:
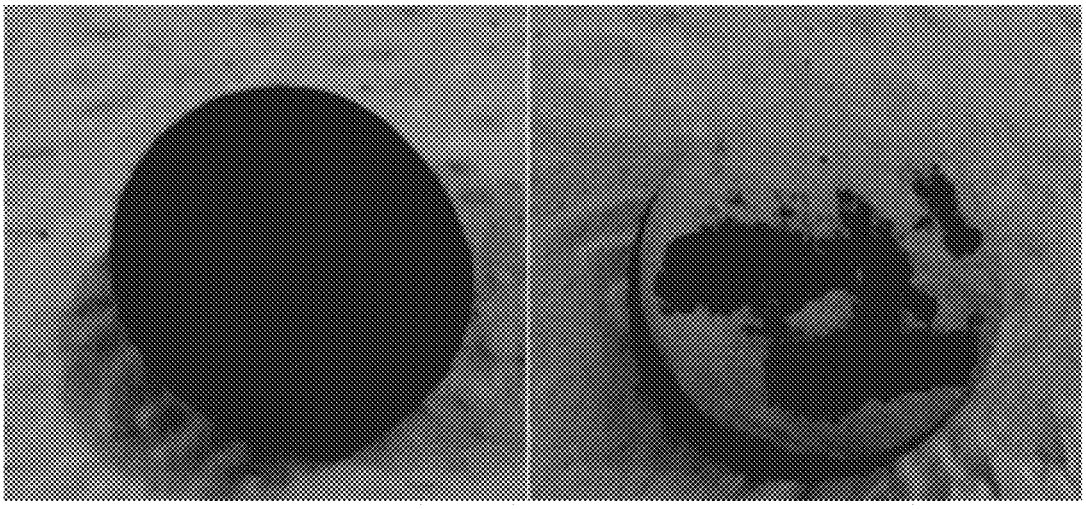
FIG. 20: Photograph of a metal part marked with the marker Mark1 in the process of forging and the metal part after thinning.

The second method used to mark the metal parts was forging. In this procedure the same mixture was used as for carburizing. In this form of feasibility of the invention, the metal parts, steel 1020, were subjected to temperature of 1100° C. and thereafter were positioned in a hydraulic press with the mixture of carburizing and marker, consisting of 0.2 g of marker+0.8 mixture for carburizing. The parts were pressed to a force of 15 tons for two minutes. FIG. 20 shows the test part after pressing and part after thinning of 0.05 mm (50 μm).

Figure 21:
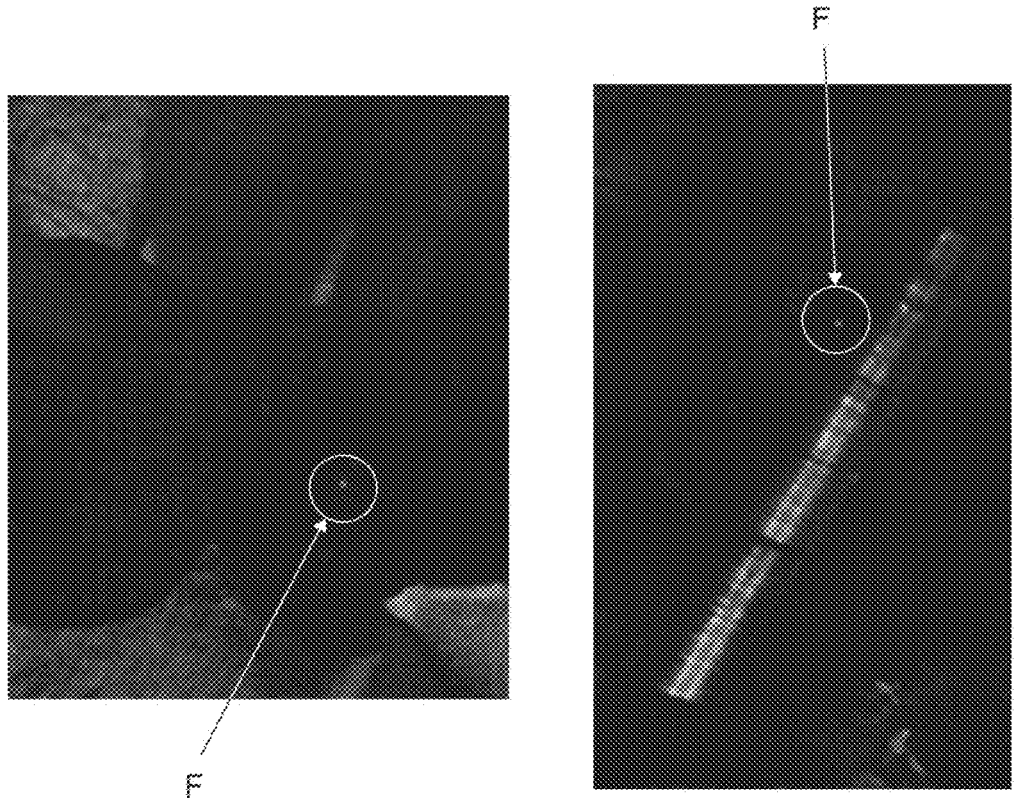
FIG. 21: Photograph showing fluorescence-emitting images from the thinned out metal parts marked by carburizing and forging, top and base respectively.
Figure 22:
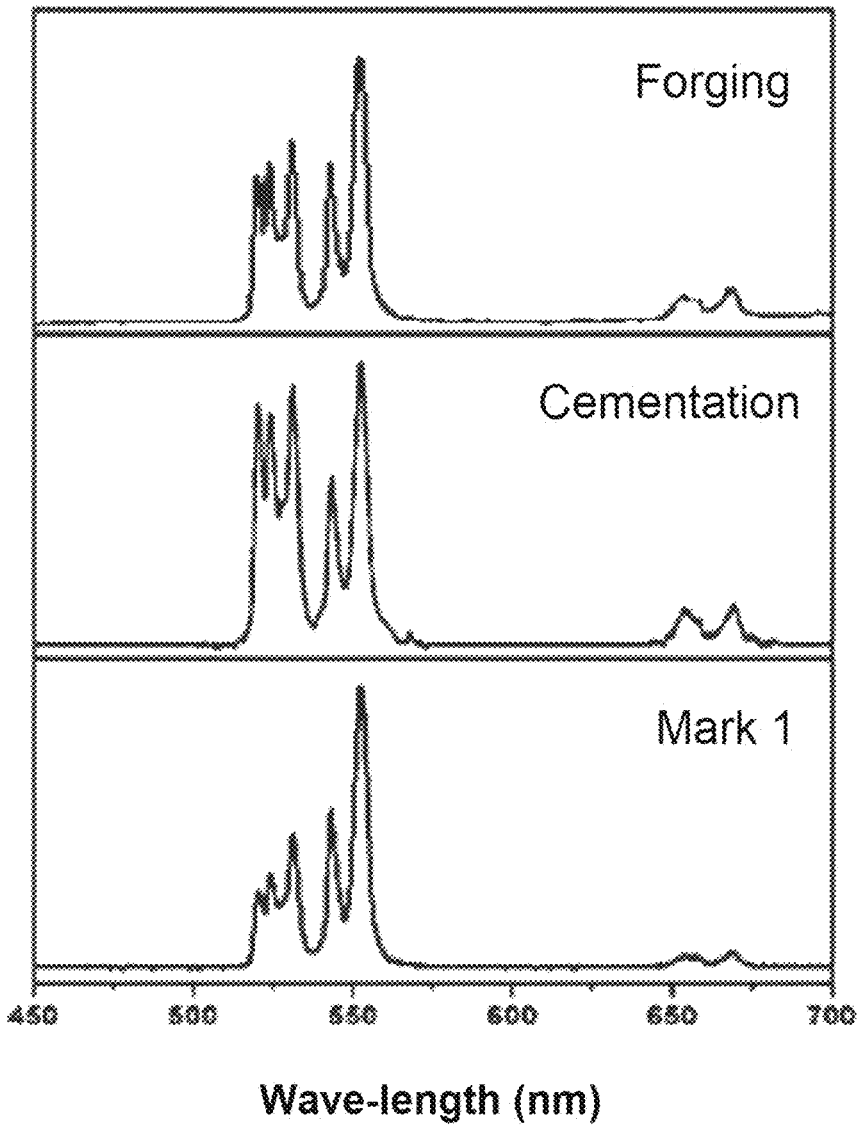
FIG. 22: Graph of the fluorescence spectrum upconversion in the range of 450 to 700 nm, which was obtained from the metal parts marked by the carburizing methodology and from the metal parts marked by forging.

To analyze the fluorescence emitted by the metal parts marked with the marker $LaNbO_4$ (Mark1) a bench top laser was used—Diode-Pumped Solid State Laser (DPSSL)

model LD-WL206—with an excitation wavelength at 980 nm. The metal parts marked using the two methodologies, carburizing and forging, presented characteristic fluorescence to the $LaNbO_4$ marker (Mark1) even after the thinning processes. For the part marked using carburizing methodology it was possible to observe the fluorescent signal referring to $LaNbO_4$ (Mark1) with a maximum thinning of 0.05 mm (50 μm). FIG. 21 shows the flourescence-emitting images (F) from the thinned out metal parts, marked by carburizing and forging, top and base respectively. FIG. 22 shows the emission spectrum of the pure marker $LaNbO_4$ (Mark1), from the metal parts marked by the carburizing methodology and from the metal parts marked by forging. It was possible to observe the similarity of the fluorescence spectrum of the pure $LaNbO_4$ (Mark1) marker in comparison to the signals obtained in the tests of marking by carburizing and forging. The little variation is due to the fact of the variation of excitation power used.

Thus, the proportions of markers, such as the marker $LaNbO_4$ (Mark1), $BiVO_4$, $Sr_3V_2O_8$ and $YNbO_4$ (called Mark2), doped with different rare earth ions (erbium, ytterbium, holmium and thulium) occurs in the range of 1 part of marker for 30000 parts to 20% explosives, ammunition, fuses and in the carburizing or forging of the steel with which the weapons are manufactured, preferably in the ratio of 1 part to 15000, to better suit the effectiveness in the use of the product, both explosives and ammunition and weapons. Depending on the product and its application the proportion is changed within the range stipulated above.

The invention claimed is:

1. A method for preparation of inorganic markers for security identification/marking on explosives, fuses, and ammunition after detonation and on firearms and metal projectiles, comprising:

a solid-state reaction, wherein the inorganic oxides are packed in polyacetal reactors containing 0.1 mm diameter zirconia balls for grinding, using a planetary mill, at a speed of 360 rpm for 4 hours, followed by calcination, in resistive furnaces, at a temperature of 1100° C., for 4 hours, to obtain $LaNbO_4$ (Mark1), $BiVO_4$, $Sr_3V_2O_8$ and $YNbO_4$ (Mark2), according to the reactions:

$$0.89La_2O_3+Nb_2O_5+0.01Er_2O_3+0.10Yb_2O_3 \rightarrow 2La_{0.89}Er_{0.01}Yb_{0.10}NbO_4$$

$$0.845Y_2O_3+Nb_2O_5+0.005Tm_2O_3+0.15Yb_2O_3 \rightarrow 2Y_{0.845}Tm_{0.005}Yb_{0.15}NbO_4$$

$$0.89Bi_2O_3+V_2O_5+0.01Ho_2O_3+0.10Yb_2O_3 \rightarrow 2Bi_{0.89}Ho_{0.01}Yb_{0.10}VO_4$$

$$2.88SrCO_3+V_2O_5+0.03Ho_2O_3+0.09Yb_2O_3 \rightarrow Sr_{2.88}Ho_{0.03}Yb_{0.09}V_2O_8+2.88CO_2$$

which are doped, respectively, with the rare-earth ion pairs: erbium (Er) and ytterbium (Yb), holmium (Ho) and ytterbium (Yb), holmium (Ho) and ytterbium (Yb) and, finally, thulium (Tm) and ytterbium (Yb).

2. The method for preparation of inorganic markers according to claim 1, wherein the markers:

Mark 1—$LaNbO_4$ is doped with 1% $Er^{3+}$ and 10% $Yb^{3+}$ and present green color;

Mark 2—$YNbO_4$ is doped with 0.5% $Tm^{3+}$ and 15% $Yb^{3+}$ and present blue color; $BiVO_4$ is doped with 1% $Ho^{3+}$ and 10% $Yb^{3+}$ and present red color; and $Sr_3V_2O_8$ is doped with 3% $Ho^{3+}$ and 9% $Yb^{3+}$ and present green color.

3. The method for preparation of inorganic markers according to claim 2, wherein the markers are used to determine the origin of explosives, fuses, ammunition, even after detonation, and in the marking of weapons and metal projectiles, from the generation of fluorescence (colors) visible to the naked eye in the waste, when excited in the infrared region (wavelength of 980 nm).

4. The method for preparation of inorganic markers according to claim 2, further comprising physically inserting the inorganic markers in explosive emulsion or in gunpowder of the projectile ammunition.

5. The method for preparation of inorganic markers according to claim 4, wherein the insertion of explosive emulsion mass is from 1 part of marker to 15000 parts per mass of explosive emulsion.

6. The method for preparation of inorganic markers according to claim 4, wherein the powder insertion of the projectile ammunition is 1 to 14% of marker in relation to gunpowder from the projectile's ammunition.

7. The method for preparation of inorganic markers according to claim 2, wherein the use of markers in steel or steel alloys of weapons occurs through cementation and forging.

8. The method for preparation of inorganic markers according to claim 7, further comprising inserting of the doped markers $LaNbO_4$ (Mark1), $BiVO_4$, $Sr_3V_2O_8$ and $YNbO_4$ (Mark 2), respectively, with the rare-earth ion pairs: erbium (Er) and ytterbium (Yb), holmium (Ho) and ytterbium (Yb), holmium (Ho) and ytterbium (Yb) and, finally, thulium (Tm) and ytterbium (Yb), in the range of 1 part of the marker to 30000 parts to 20%, preferably in the ratio of 1 part to 15000, to better suit the effectiveness in the use of the product, both explosives, as ammunition and armaments.

9. The method for preparation of inorganic markers according to claim 7, wherein, in the cementation, a mixture of 10 to 20% of marker is used in a mixture suitable for cementation, which consists of commercial powder for cementation.

10. The method for preparation of inorganic markers according to claim 9, wherein, for cementation, a mixture of the powders is carried out manually, using a spatula; a mass of 5 g of the mixture is used, of which 1 g of the marker+4 g of the mixture for cementation; the metal parts (steel 4140) are subjected to a temperature of 900° C. and then placed individually, on the marking mixture, during the period of one minute, and subsequently subjected to an oil quenching.

* * * * *